US006696676B1

(12) United States Patent
Graves et al.

(10) Patent No.: US 6,696,676 B1
(45) Date of Patent: Feb. 24, 2004

(54) VOLTAGE COMPENSATION IN COMBINATION OVEN USING RADIANT AND MICROWAVE ENERGY

(75) Inventors: Todd Vincent Graves, Louisville, KY (US); Dennis Patrick Kill, Louisville, KY (US); Jesse Spalding Head, Louisville, KY (US); Charles Ray Smith, Shelbyville, KY (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/481,064

(22) Filed: Jan. 11, 2000

Related U.S. Application Data

(60) Provisional application No. 60/126,885, filed on Mar. 30, 1999.

(51) Int. Cl.[7] ..... H05B 6/68

(52) U.S. Cl. ..... 219/716; 219/718; 219/685; 219/719; 219/492; 99/325

(58) Field of Search ..... 219/716, 718, 219/717, 719, 702, 685, 681, 482, 483, 486, 492, 497; 99/325, 327, 332, 451; 323/299; 361/79, 86, 91, 92

(56) References Cited

U.S. PATENT DOCUMENTS

| | | | | | |
|---|---|---|---|---|---|
| 4,227,062 | A | * | 10/1980 | Payne et al. | 219/718 |
| 4,317,977 | A | * | 3/1982 | Buck | 219/702 |
| 4,477,706 | A | * | 10/1984 | Mittelsteadt | 219/685 |
| 4,568,810 | A | * | 2/1986 | Carmean | 219/720 |
| 4,798,927 | A | * | 1/1989 | Kaminaki | 219/718 |
| 5,317,133 | A | * | 5/1994 | Sundstrom et al. | 219/716 |
| 5,695,669 | A | | 12/1997 | Westerberg | |

FOREIGN PATENT DOCUMENTS

| | | | | |
|---|---|---|---|---|
| JP | 57-125412 | * | 8/1982 | |
| JP | 6-113959 | * | 4/1994 | 99/332 |

* cited by examiner

*Primary Examiner*—Philip H. Leung
(74) *Attorney, Agent, or Firm*—H. Neil Houser, Esq.; Armstrong Teasdale, LLP

(57) ABSTRACT

An oven includes both radiant cooking elements and a microwave cooking element that are controlled to reduce cooking time in relation to known radiant ovens. The oven is operable in a speed cooking mode utilizing radiant and microwave cooking elements, a microwave cooking mode utilizing only the magnetron, and a radiant cooking mode utilizing only radiant lamps. In addition, and using a time adjustment algorithm, the total energy into the food is maintained constant for input voltages in a range between about 108 Volts and 132 Volts to suitably cook food even when the input voltage varies.

16 Claims, 15 Drawing Sheets

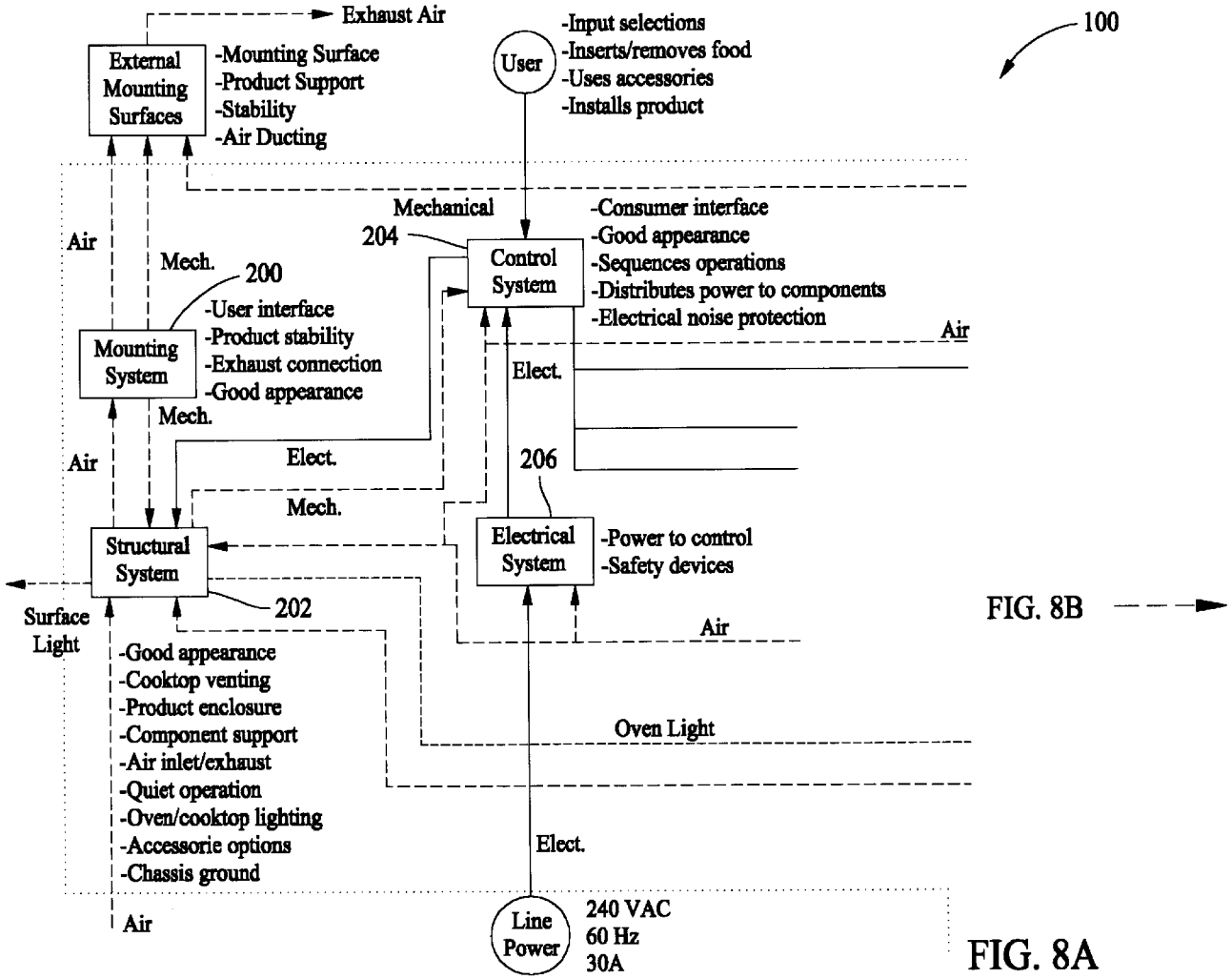
100
User
-Input selections
-Inserts/removes food
-Uses accessories
-Installs product
Control System
204
-Consumer interface
-Good appearance
-Sequences operations
-Distributes power to components
-Electrical noise protection
Mechanical
Elect.
Air
Electrical System
206
-Power to control
-Safety devices
Air
Oven Light
Elect.
Line Power
240 VAC
60 Hz
30A
FIG. 8B
FIG. 8A
External Mounting Surfaces
-Mounting Surface
-Product Support
-Stability
-Air Ducting
Exhaust Air
Mech.
Mounting System
200
-User interface
-Product stability
-Exhaust connection
-Good appearance
Mech.
Air
Elect.
Mech.
Structural System
202
-Good appearance
-Cooktop venting
-Product enclosure
-Component support
-Air inlet/exhaust
-Quiet operation
-Oven/cooktop lighting
-Accessorie options
-Chassis ground
Air
Surface Light

VOLTAGE COMPENSATION IN COMBINATION OVEN USING RADIANT AND MICROWAVE ENERGY

CROSS REFERENCE TO RELATED APPLICATIONS

This application claims the benefit of U.S. provisional application No. 60/126,885 filed Mar. 30, 1999.

BACKGROUND OF THE INVENTION

This invention relates generally to ovens and, more particularly, to a combination oven using both radiant and microwave energy.

In ovens including both radiant cooking elements and a magnetron, or microwave, cooking element, the cooking elements are controlled to provide reduced cooking time as compared to known radiant ovens, yet a wide variety of foods can be cooked in such ovens. One such combination oven is operable in a speed cooking mode wherein both radiant and microwave cooking elements are utilized, in a microwave only cooking mode wherein only the magnetron is utilized for cooking, and a radiant only cooking mode wherein only the lamps are utilized for cooking.

The radiant cooking elements, in one embodiment, are Halogen lamps. The power output from such lamps varies depending on the magnitude of the supply voltage. Specifically, with the Halogen lamps, the lamp resistance is constant and the output wattage is equal to input voltage squared over lamp resistance. Therefore, as the input voltage varies, the output wattage also varies.

In the United States, household voltages can vary by as much as ten percent. As a result, the output power of the heating components in a cooking appliance such as the above described combination oven can vary by more than twenty percent. Compensation for such variations must be provided in order to provide acceptable cooking results.

BRIEF SUMMARY OF THE INVENTION

In an exemplary embodiment of the invention a time adjustment algorithm for a combination oven provides that total energy into the food is constant for an input voltage in a range between about 108 Volts and 132 Volts. More particularly, and in one embodiment, the time adjustment algorithm provides that total cooking time is adjusted by subtracting or adding a time adjustment value to a selected total cooking time. The time adjustment value, in one embodiment, is determined in accordance with the following relationship.

$$\text{Time Adjustment}=\text{Total cooking time}*\{5(\text{Voltage Deviation}/120\ \text{Volts})^2-1.5(\text{Voltage Deviation}/120\ \text{Volts})\}$$

The total cooking time value is determined in accordance with the power level selected by the user as described below in more detail. The voltage deviation value is the deviation from nominal 120 Volts. The time adjustment value may have a positive or negative value, and is simply added to the total cooking time value.

Using the above described time adjustment, the total energy into the food is maintained constant for input voltages in a range between about 108 Volts and 132 Volts. Such time adjustment provides that suitable cooking results are achieved even when the input voltage varies over a wide range.

DETAILED DESCRIPTION OF THE INVENTION

The present invention is directed, in one aspect, to operation of an oven that includes at least two types of cooking elements, such as radiant and microwave cooking elements. Although one specific embodiment of a radiant/microwave cooking oven is described below, it should be understood that the present invention can be utilized in combination with many other such ovens and is not limited to practice with the oven described herein. For example, the oven described below is an over the range type oven. The present invention, however, is not limited to practice with just over the range type ovens and can be used with many other types of ovens.

Figure 1:
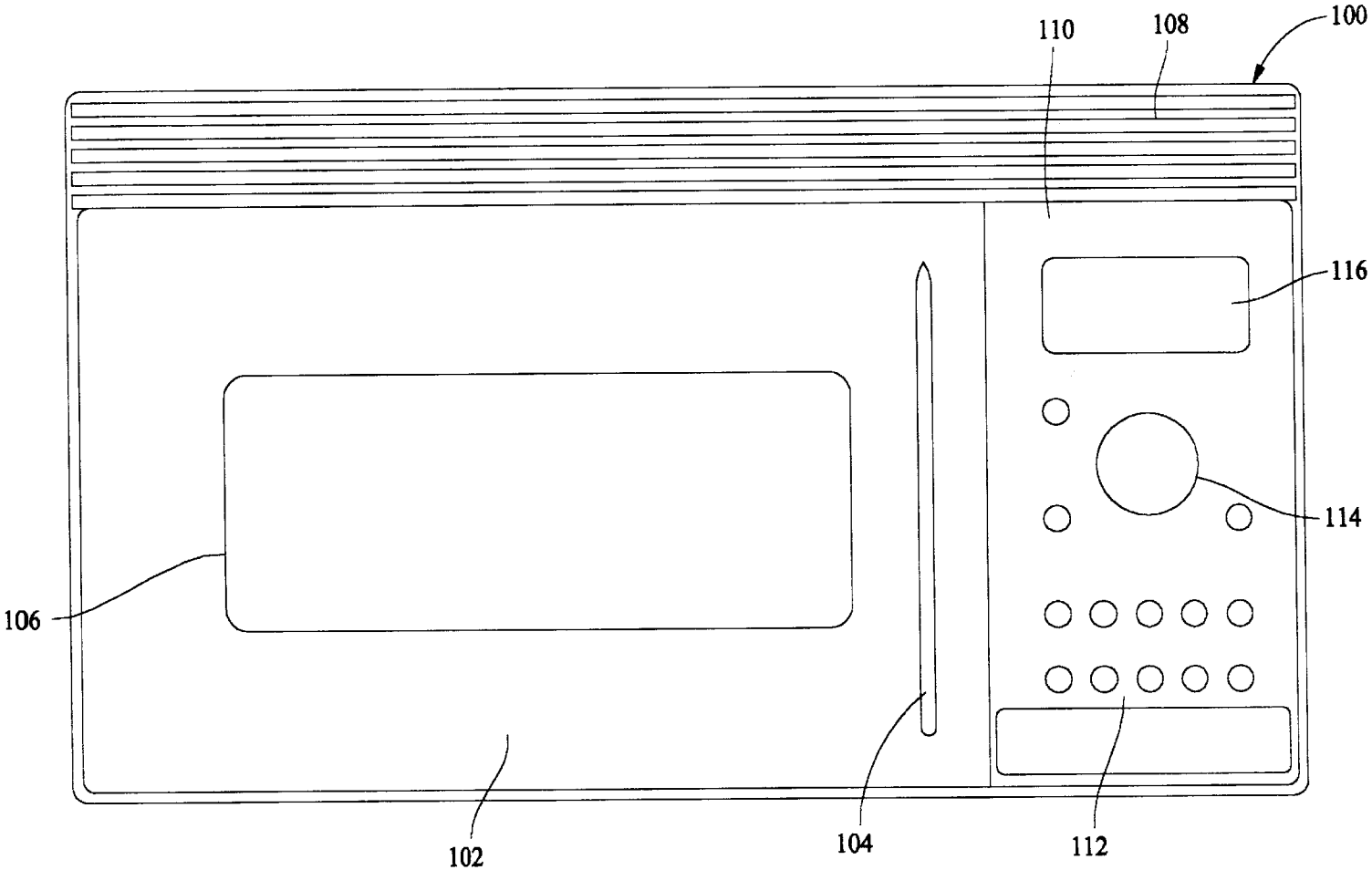
FIG. 1 is a front view of an oven in accordance with one embodiment of the present invention.

FIG. 1 is a front view of an over the range type oven 100 in accordance with one embodiment of the present invention. Oven 100 includes a frameless glass door 102 having an injection molded handle 104. A window 106 is provided for visualizing food in the oven cooking cavity. Door 102 has an inner metal frame that extends around the door periphery and comprises an RF door choke. The glass of door 102 has, for example, a thickness of about ⅛" and can withstand high temperatures, as is known in the art, and is secured to the inner metal frame by an adhesive. Handle 104 also is secured to the metal frame by bolts that extend through openings in the glass. Oven 100 also includes an injection molded plastic vent grille 108 and a frameless glass control panel 110.

Rubber tactile switch covers 112 are located over each key pad of panel 110, and an injection molded knob or dial 114 is provided for making multiple selections. Selections are made using dial 114 by rotating dial 114 clockwise or counter-clockwise and when the desired selection is displayed, pressing dial 114. The various selections available, in an exemplary embodiment, from dial 114 are set forth in Appendix A. Instructions and selections are displayed on a vacuum fluorescent display 116.

The following functions can be selected from respective key pads of panel 110.

| | |
|---|---|
| CLEAR/OFF | Selecting this pad stops all cooking and erases the current program. |
| DELAYED START | Selecting this pad results in a delay in the start of cooking. |
| HELP | Selecting this pad enables an operator to find out more about the oven and its features. |
| MICROWAVE | Selecting this pad enables defrosting, heating beverages, reheating leftovers, popcorn, vegetables, and all types of microwave cooking. |
| MICROWAVE EXPRESS | Selecting this pad enables quick and easy warming of a sandwich, or reheat of coffee. |
| OPTIONS ON/OFF | Selecting this pad enables access to the auto night light, beeper volume control, clock, clock display, and display scroll speed features. |
| OVEN LIGHT | Selecting this pad during microwave cooking illuminates the cavity. |
| POWER LEVEL | Selecting this pad enables adjusting the power levels for speed cooking and microwave cooking. |
| REMINDER | Selecting this pad enables an operator to select a time at which an alarm is to sound. |
| REPEAT LAST | Selecting this pad facilitates cooking repetitive items such as cookies and appetizers. |
| SPEED COOK MANUAL | Selecting this pad enables an operator to manually enter speed cooking time and power levels. |
| START/PAUSE | Selecting this pad enables an operator to start or pause cooking. |
| SURFACE LIGHT | Selecting this pad turns ON/OFF the surface light for the cooktop. |
| TIMER ON/OFF | Selecting this pad controls a general purpose timer (e.g., minutes and seconds) |
| VENT FAN | Selecting this pad enables an operator to clear the cooktop area of smoke or steam. |

Figure 2:
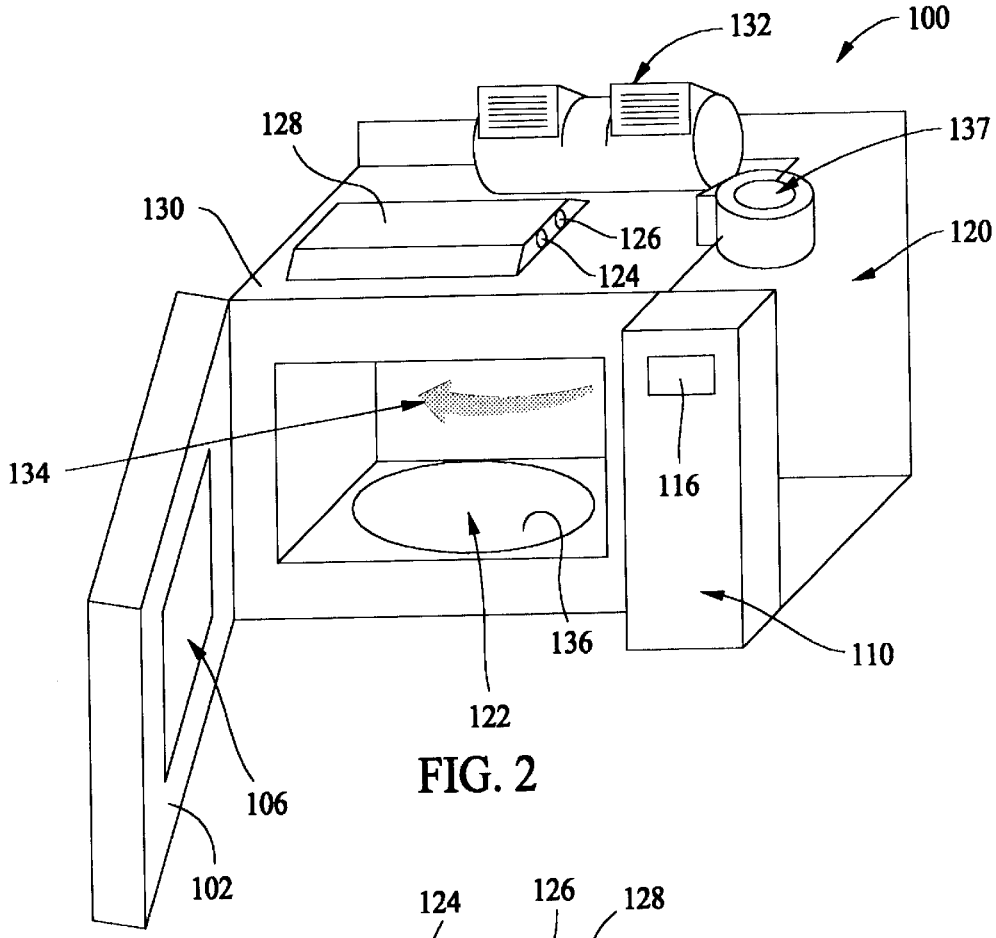
FIG. 2 is a perspective schematic view of a portion of the oven shown in FIG. 1.

FIG. 2 is a perspective schematic view of a portion of oven 100. Oven 100 includes a shell 120, and a cooking cavity 122 is located within shell 120. Cooking cavity 122 is constructed using high reflectivity (e.g., 72% reflectivity) stainless steel. Halogen lamps 124 and 126, and a reflective plate 128 are mounted to an upper panel 130 of shell 120. As described below in more detail, a halogen lamp also is located at a lower section of shell 120. An exhaust system 132 also is mounted to shell 120. Air flows through cavity 122 in a direction indicated by arrow 134. A cooling system 137 is mounted to shell 120 for cooling oven components. Exemplary dimensions of oven 100 are set forth below.

| | |
|---|---|
| Shell | |
| Exterior Height (front) | 15 11/16" |
| Exterior Height (rear) | 16½" |
| Exterior Width | 29⅝" |
| Exterior Depth | 14⅝" |
| Cooking Cavity | |
| Cavity Height | 8⅜" |
| Cavity Width | 19 9/16" |
| Cavity Depth | 13⅜" |

Figure 3:
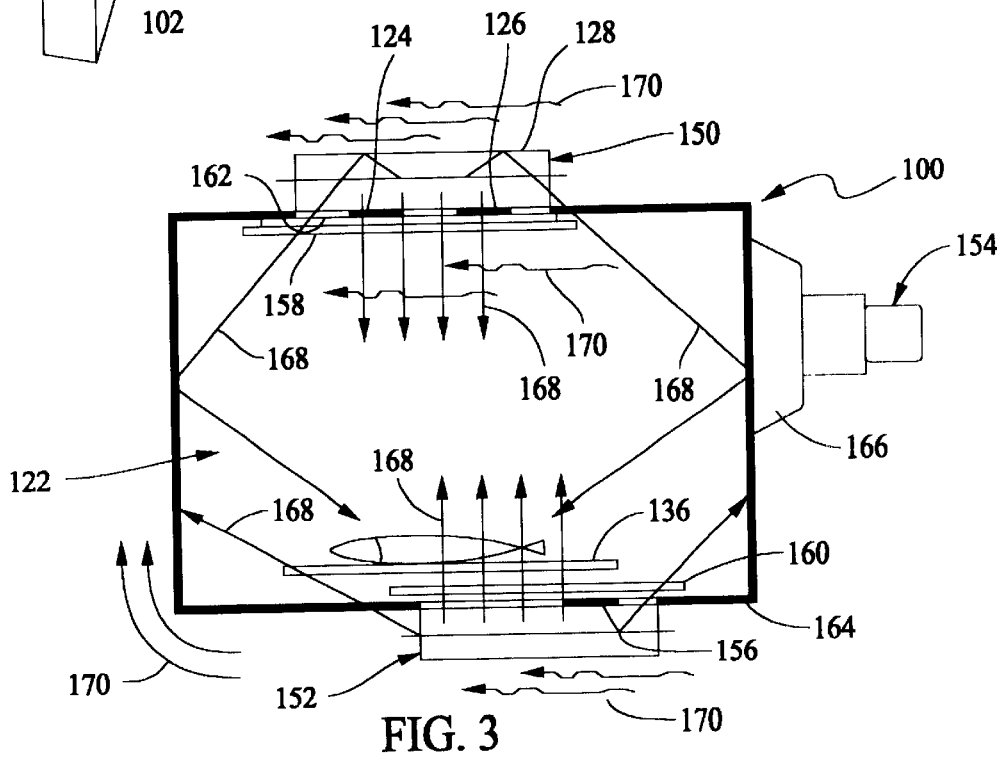
FIG. 3 is a schematic illustration of the radiant cooking unit and the microwave cooking unit relative to the cooking cavity.

FIG. 3 is a schematic illustration of oven 100, and particularly of halogen lamp cooking units 150 and 152 and microwave cooking unit 154 relative to cooking cavity 122. As shown in FIG. 3, upper cooking unit 150 includes two halogen lamps 124 and 126 and cooking unit 152 includes one halogen lamp 156. Lamps 124, 126, and 156, in an exemplary embodiment, are 1500 W halogen lamps having a color temperature of 2300K, each with an output power of 1.5 kW (4.5 kW total for all three lamps). Lamp 124 is referred to as the upper center lamp, and lamp 126 is referred to as the upper exterior lamp. Lamp 156 is referred to as the lower lamp. Glass plates 158 and 160 extend over cooking units 150 and 152 between lamps 124, 126, and 156 and cavity 122. Also, twist mesh screens 162 and 164 having an opening ratio of 80% are provided for additional protection. Additional details are provided below with respect to reflector 128. A magnetron 166 of microwave cooking unit 154 is located on a side of cavity 122. Magnetron 166, in an exemplary embodiment, delivers a nominal 950 W into cavity 122 according to standard IEC (International Electrotechnical Commission) procedure.

Figure 4:
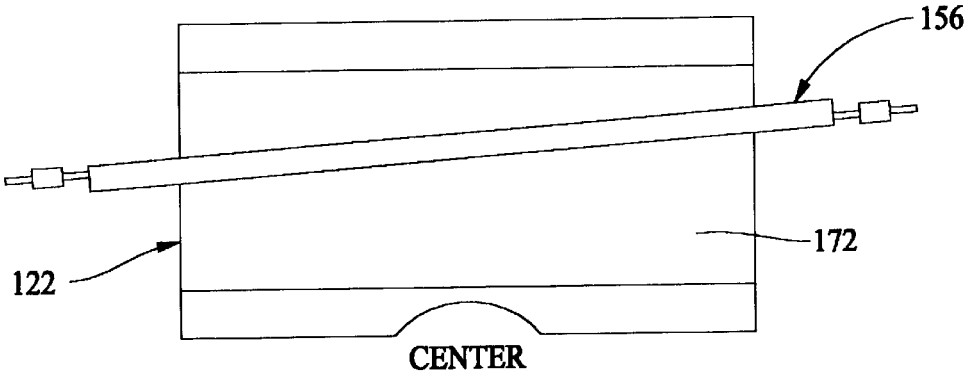
FIG. 4 is a schematic illustration of the lower lamp of the oven shown in FIG. 1.

With respect to lower lamp 156, and referring to FIG. 4, lamp 156 is located off center and at an angle relative to a bottom surface 172 of cavity 122. Such location of lower lamp 156 results, for example, in lowering the temperature of the rollers on turntable 136.

Figure 5:
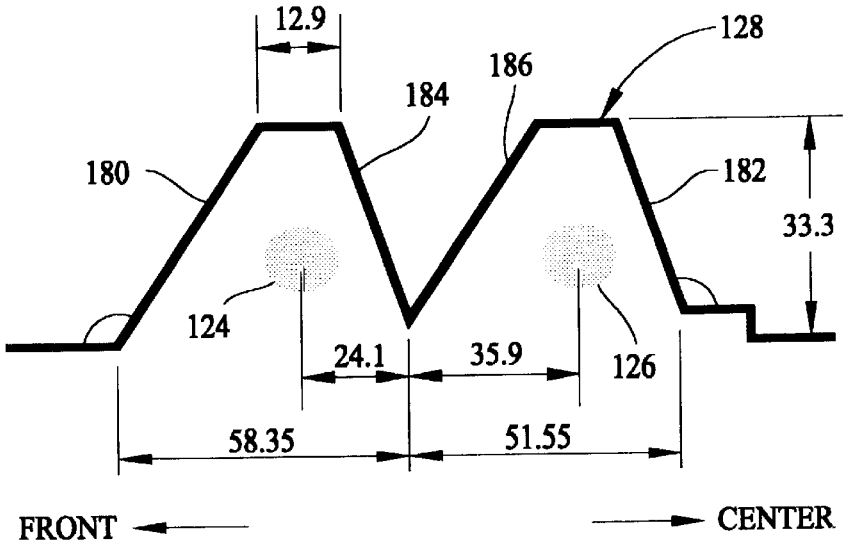
FIG. 5 is a schematic illustration of the reflector for the upper lamps of the oven shown in FIG. 1.

FIG. 5 is a schematic side illustration of reflector 128. Reflector 128 includes angular side sections 180 and 182 and angular center sections 184 and 186. The dimensions (in millimeters) indicated in FIG. 5 are exemplary and have been found suitable for at least one oven. By selecting the reflector dimensions as indicated in FIG. 5, upper lamps 124 and 126 are believed to provide more even cooking of items located on turntable 136.

Figure 6:
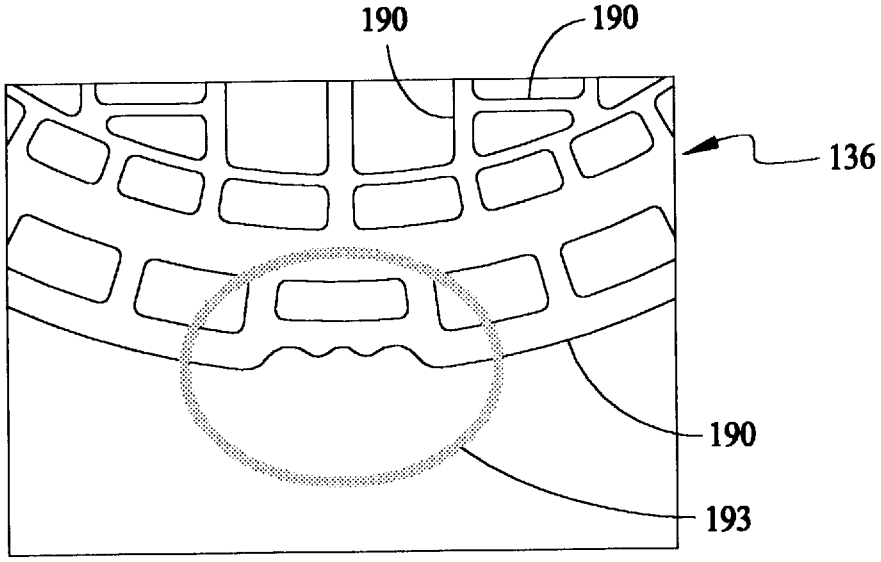
FIG. 6 is an illustration of a portion of the turntable of the oven shown in FIG. 1.

FIG. 6 illustrates a portion of turntable 136. Turntable 136 has an open grille construction with a 70% energy transmission. Turntable 136 rotates at about 6 r.p.m. and has a diameter of about 11⅛". Turntable 136 includes metal segments 190 with ceramic rollers 192, one of which is illustrated within circle 194.

Figure 7:
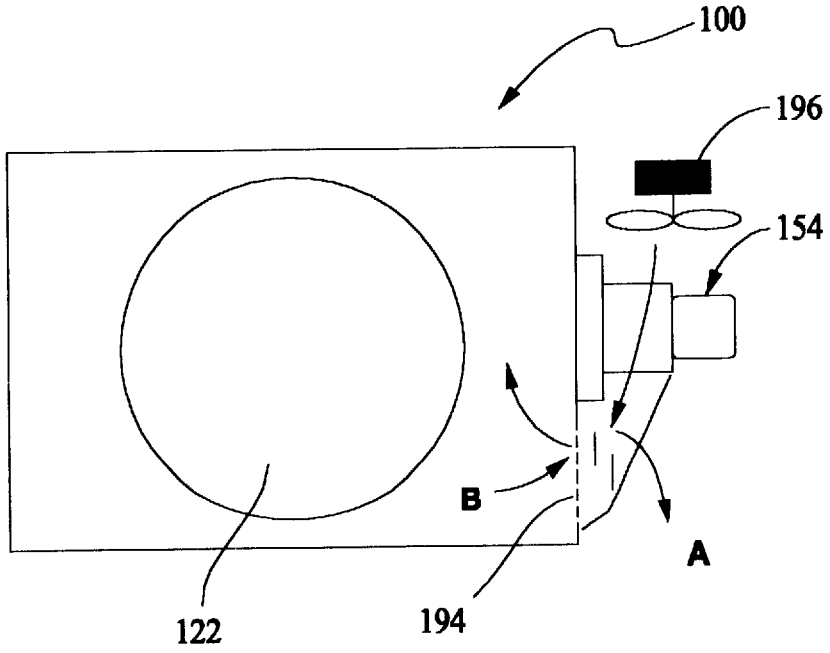
FIG. 7 is a schematic illustration of the cooking cavity of the oven shown in FIG. 1, including a damper to control air flow.

FIG. 7 illustrates a damper 194 located below microwave cooking unit 154. Damper 194 is open when in the microwave only mode to enable air to flow through cavity 122. In the speed cooking and radiant only mode, damper 194 closes to prevent air from flowing in a reverse direction and back towards microwave cooking unit 154.

Figures 8A, 8B:
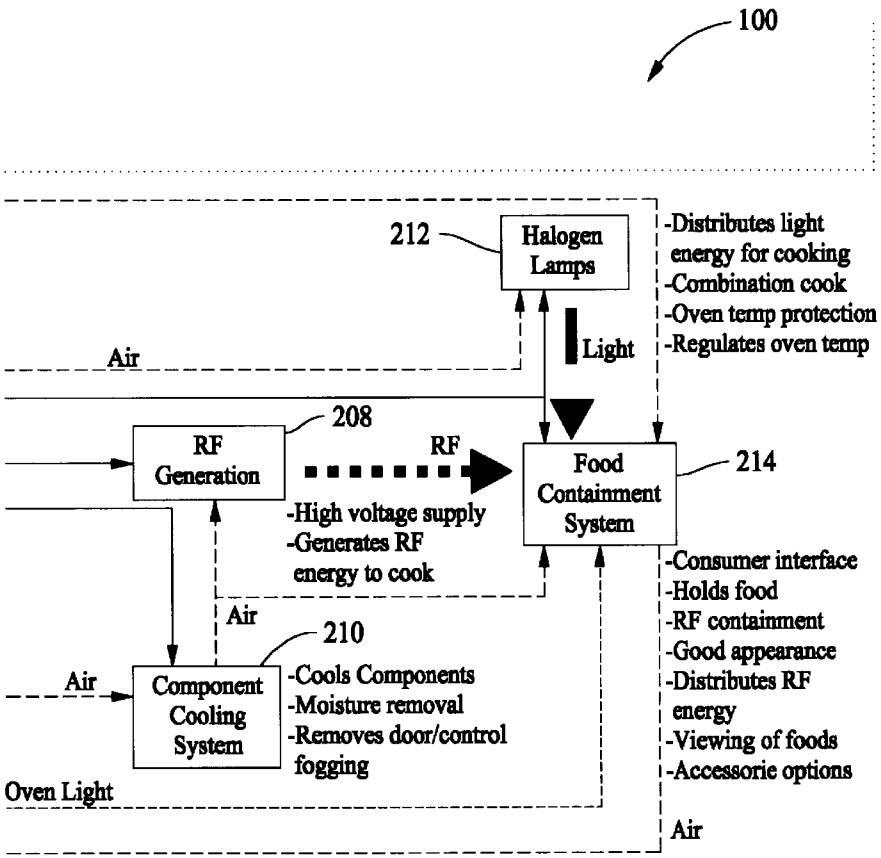
FIG. 8A is a first portion of a functional block diagram of the oven shown in FIG. 1.
FIG. 8B is a second portion of the functional block diagram of the oven shown in FIG. 1.

FIG. 8 is a functional block diagram of oven 100. As shown in FIG. 8, oven 100 includes a mounting system 200, a structural system 202, a control system 204, an electrical system 206, RF generation 208, a component cooling system 210, halogen lamps 212, and a food containment system 214. Various features of each system are indicated in FIG. 8. Mounting system 200 is provided to enable mounting oven over the range. Mounting system 200 also provides connection with an exhaust to enable removal of fumes from over the cooktop into the exhaust. Structural system 202 generally refers to shell 120, which provides an enclosure. Control system 204 includes an interface, i.e., keypads 112 and dial 114, and also distributes power to the other oven systems. Electrical system 206 powers the control and safety devices. RF generation 208 is performed by magnetron 166, and RF energy output by magnetron 166 is selectively used to cook food in food containment system. Component cooling system 210 is provided to cool the other system and to remove moisture from cavity 122. Halogen lamps 212 generate light energy used for cooking food in food containment system 214.

Figure 9A:
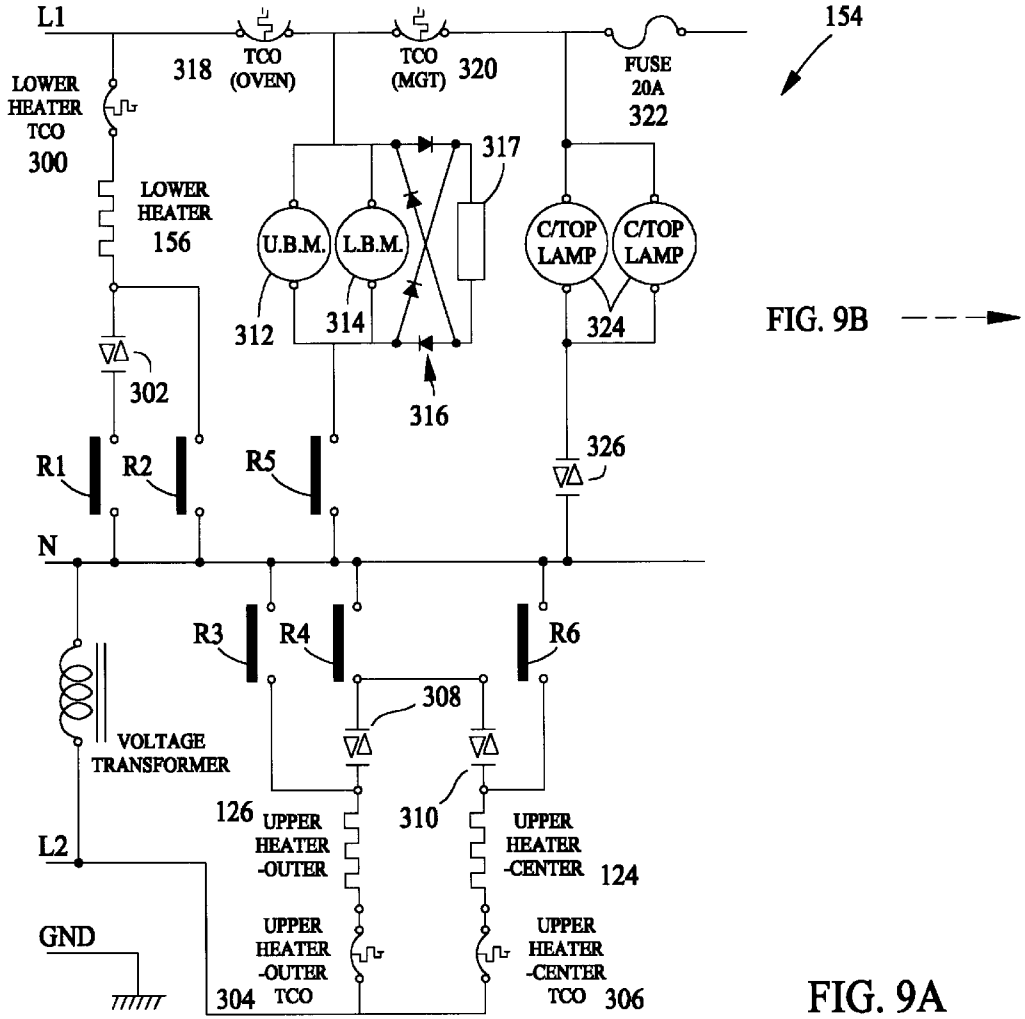
FIG. 9A is a first portion of a circuit schematic diagram of the oven shown in FIG. 1.
Figures 9A, 9B:
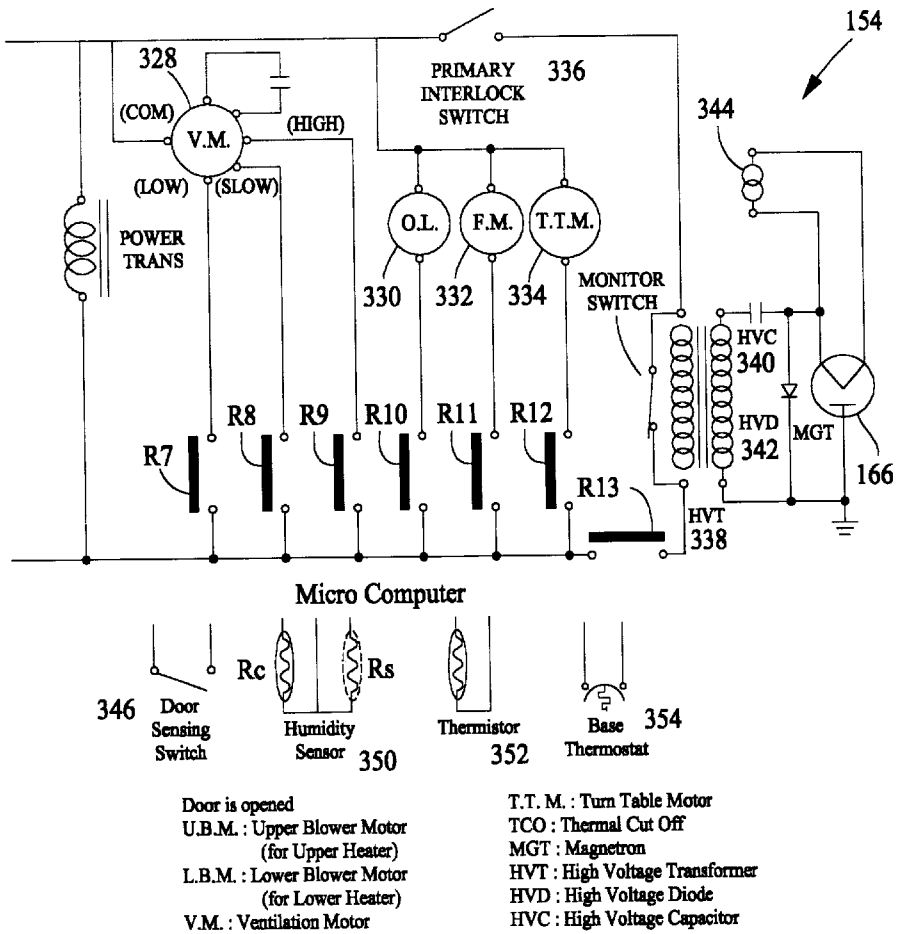
FIG. 9B is a second portion of the circuit schematic diagram of the oven shown in FIG. 1.

FIG. 9 is a schematic diagram of oven 100. Power is provided to oven 100 via lines L1, L2, and N. Relays R1–R13 are connected to a microcomputer which is programmed to control the opening and closing thereof. Lower lamp 156 is electrically connected to line L1 via a thermal cut off 300. Energization of lower lamp 156 is controlled by relays R1 and R2. A triac is in series with relay R1 to provide a soft start, as described below in more detail. Upper lamps 126 and 124 are connected to line L2 via thermal cut offs 304 and 306. Triacs 308 and 310 are in series with relay R4.

Relays R1 and R4 are air gap type relays, and are in series with triacs 302 and 308, respectively. Relays R1 and R4 are closed in the soft start operation of respective lamps 124, 126, and 156 to enable energization of triacs 302 and 308. After completion of the soft start, relays R1 and R4 are open. Relays R2, R3, and R6 are controlled by the microcomputer to close after the soft start is completed to hold lamps 124, 126, and 156 on based on the particular power setting.

Oven 100 also includes an upper blower motor 312 and a lower blower motor 314 for cooling. A rectifier circuit 316 is provided for rectifying an AC input signal to a DC output signal to be supplied to a synchronous motor 317. Synchronous motor 317, when energized, closes damper 194. Thermal cut outs 318 and 320 and a fuse 322 also are provided to protect oven components, e.g., from overheating or an overcurrent condition. Cooktop lamps 324 are electrically connected in series with a triac 326 and are provided for illuminating the cooktop.

A vent motor 328 having low, slow, and high speeds selectable via relays R7, R8, and R9 is provided for removing fumes from over the cooktop. An oven lamp 330, fan motor 332, and a turn table motor 334 are controlled by separate relays R10, R11, and R12. A primary interlock switch 336 is located in door 102 and prevents energization of cooking elements unless door 102 is closed. A relay R13 controls energization of microwave cooking unit 154. Microwave cooking unit 154 includes a high voltage transformer 338 which steps up the supply voltage from 120V to 2000V. A high voltage capacitor 340 and a high voltage diode 342 circuit steps up the voltage from transformer 338 from 2000V to 4000V. This high voltage is supplied to magnetron 166 and the output of magnetron 166 is supplied to a waveguide 344 which directs RF energy into cooking cavity 122. As also shown in FIG. 9, oven 100 includes a door sensing switch 346 for sensing whether door 102 is opened, a humidity sensor 350 for sensing the humidity in cooking cavity 122, a thermistor 352, and a base thermostat 354.

With respect to speed cooking operation of oven 100, the microcomputer controls relays R1–R6 and R13 based on the power level either associated with the preprogrammed cooking program or manually entered. In the speed cooking mode, for example, if a power level 9 is selected, the upper exterior lamp 126 has a target on-time of 29 seconds of a 32 second duty cycle, upper center lamp 124 has a target on-time of 25 seconds of a 32 second duty cycle, lower lamp 156 has a target on-time of 29 seconds of a 32 second duty cycle, and magnetron 16 has a target on-time of 29 seconds of a 32 second duty cycle. A duty cycle of approximately 32 seconds is selected for one particular implementation. However, a other duty cycles could be utilized. Set forth below is a chart which sets forth the target on-times based on power level.

| Power Level | Upper Exterior Lamp | Upper Center Lamp | Lower Lamp | Magnetron |
|---|---|---|---|---|
| 0 | 0 | 0 | 0 | 0 |
| 1 | 3 | 3 | 3 | 3 |
| 2 | 6 | 5 | 6 | 6 |
| 3 | 10 | 8 | 10 | 10 |
| 4 | 13 | 11 | 13 | 13 |
| 5 | 16 | 14 | 16 | 16 |
| 6 | 19 | 16 | 19 | 19 |
| 7 | 22 | 19 | 22 | 22 |
| 8 | 26 | 22 | 26 | 26 |
| 9 | 29 | 25 | 29 | 29 |
| 10 | 32 | 27 | 32 | 32 |

To increase lamp reliability, a soft start operation is used when energizing lamps 124, 126, and 156. Particularly, in accordance with the soft start operation, triacs 302, 308, and 310 are utilized to delay lamp turn-on. For example, upper exterior lamp 126 and lower lamp 156 are delayed for one second from commanded turn-on to actual turn-on. Upper center lamp 124 is delayed for two seconds from commanded turn-on to actual turn-on. Therefore, the target turn-on times are different from the commanded on-times. Set forth below is a table containing the commanded on-times based on power level selected.

| Power Level | Upper Exterior Lamp | Upper Center Lamp | Lower Lamp | Magnetron |
|---|---|---|---|---|
| 0 | 0 | 0 | 0 | 0 |
| 1 | 4 | 5 | 4 | 3 |
| 2 | 7 | 7 | 7 | 6 |
| 3 | 11 | 10 | 11 | 10 |
| 4 | 14 | 13 | 14 | 13 |
| 5 | 17 | 16 | 17 | 16 |
| 6 | 20 | 18 | 20 | 19 |
| 7 | 23 | 21 | 23 | 22 |
| 8 | 27 | 24 | 27 | 26 |
| 9 | 30 | 27 | 30 | 29 |
| 10 | 32 | 29 | 32 | 32 |

For example, if upper lamps 124 and 126 are to operate at power level 7, then upper lamp 124 would be commanded to operate for 21 seconds and upper exterior lamp 126 would be commanded to operate for 23 seconds. Lamps 124 and 126 would be commanded to turn-on for 21 and 23 seconds, respectively, at the beginning of each 32 second duty cycle. Due to the soft-start delays, lamps 124 and 126 would actually be on for 19 seconds (lamp 124) and 22 seconds (lamp 126) of each 32 second duty cycle.

Figure 10:
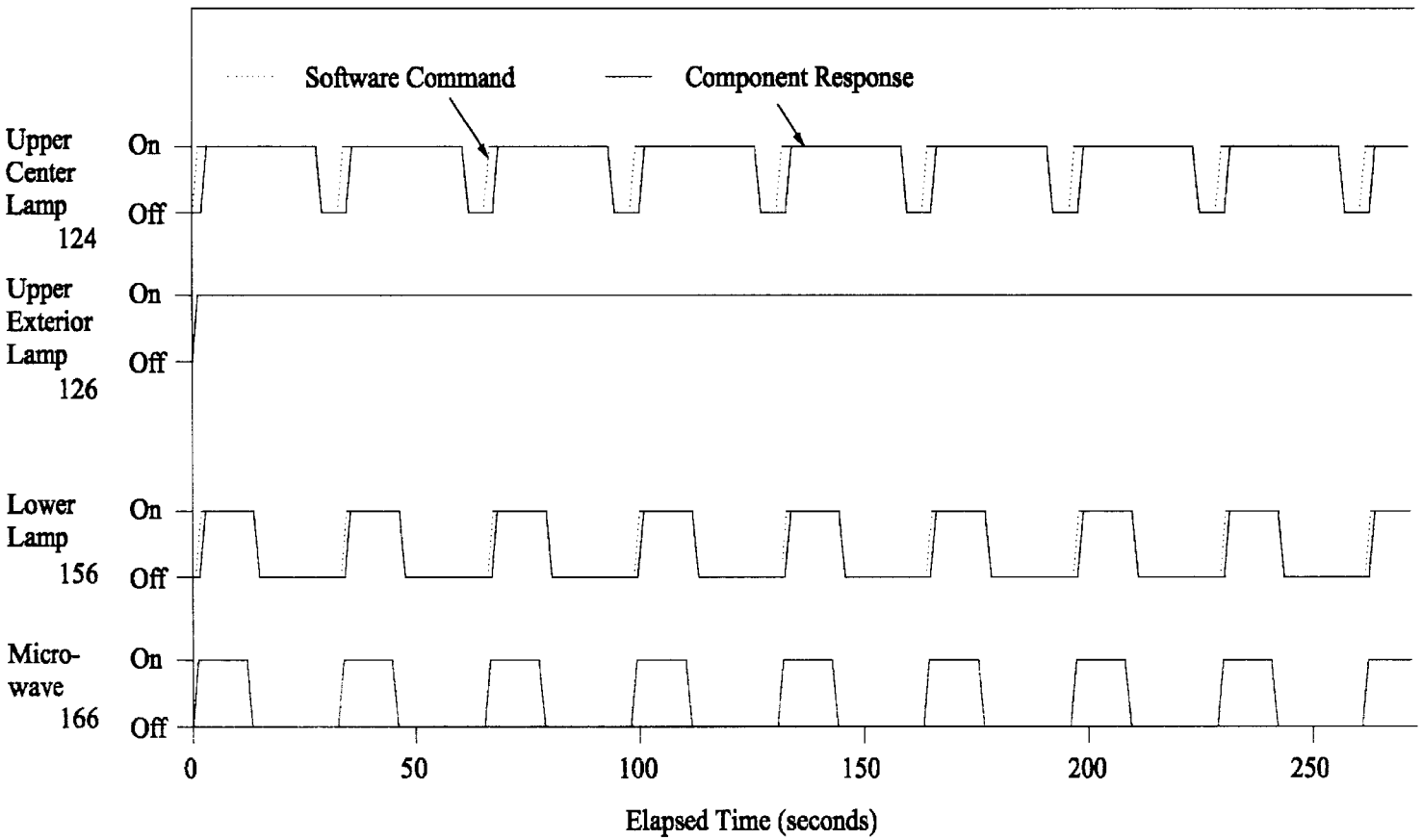
FIG. 10 is a timing diagram illustrating target and command times for energizing the cooking elements.

FIG. 10 is a timing diagram illustrating the state of lamps 124, 126, and 156, and magnetron 166. In the example, refrigerated crescent rolls are to be cooked in accordance with the following:

Total Time: 4:30

Upper Power Level: 10

Lower Power Level: 3

Microwave Power Level: 3

As shown in FIG. 10, upper center lamp 124 is commanded on (dashed line) two seconds before it actually turns on (solid line). Lamp 124 is on for 27 seconds of each 32 second period. Upper exterior lamp 126 is always on during this period. Lower Lamp 156 is on one second after it is commanded to turn on, and in on for 10 seconds out of each 32 second period. Magnetron 166 has no delay between command and execution of on time, and is on for 10 seconds of each 32 second period.

Figure 11:
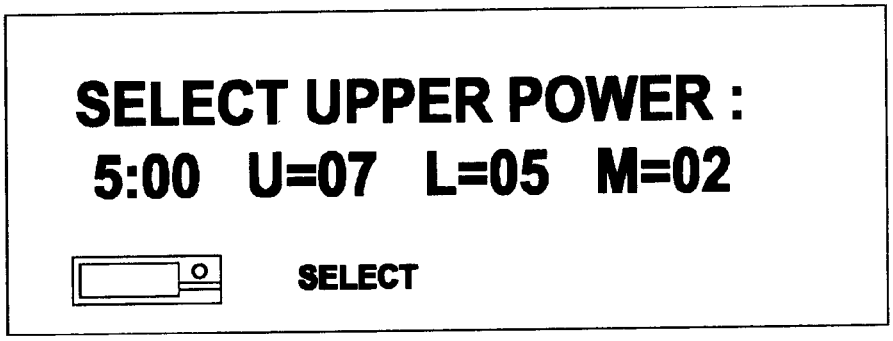
FIGS. 11–14 illustrate messages displayed when adjusting/entering the power level and cooking time.
Figure 12:
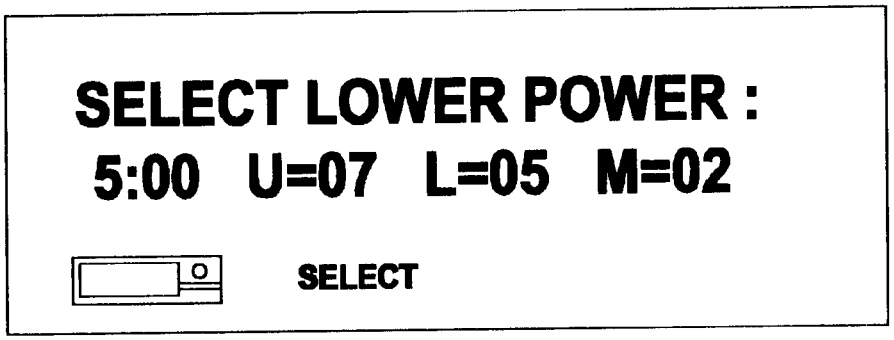
Figure 13:
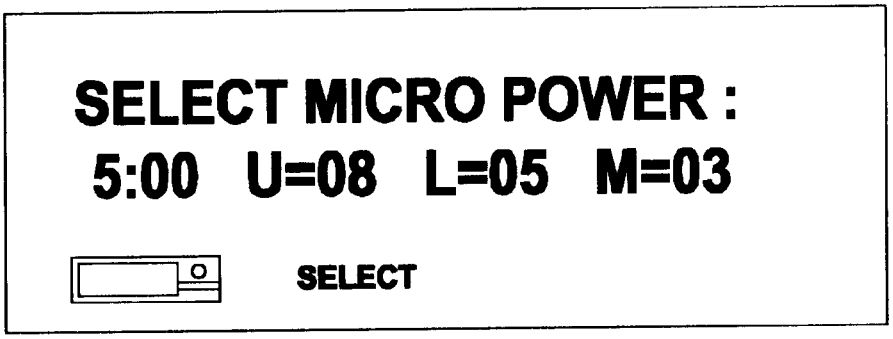
Figure 14:
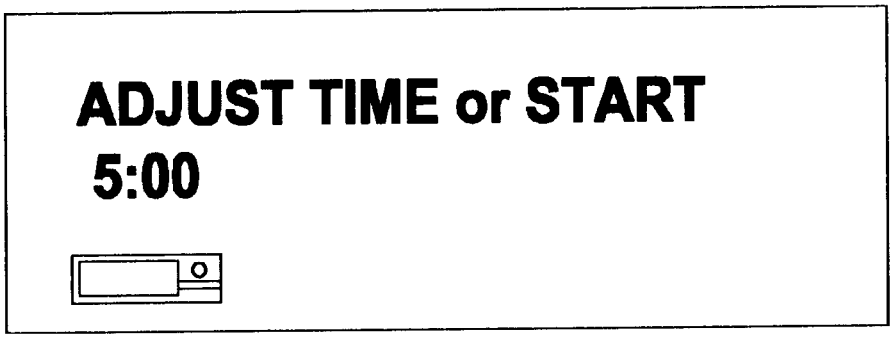

An operator may adjust the power level of the upper lamps, the lower lamp, and the microwave during operation. To change the power level, the operator selects the POWER LEVEL pad and a select icon flashes on display 116. A message "Select UPPER POWER" then is displayed as shown in FIG. 11. Rotation of dial 114 then enables an operator to select the upper power level (clockwise rotation increases the power level and counter clockwise rotation decreases the power level). When dial 114 is pressed to enter the selection, a short beep sounds and "Select LOWER POWER" is displayed as shown in FIG. 12. Dial rotation then alters the current lower power level, and when dial 114 is pressed, a short beep is sounded. Then, "Select MICRO POWER" is displayed as shown in FIG. 13. Dial rotation now alters the microwave power level. When dial 114 is pressed to enter the selection, a short beep is sounded and the OVEN icon flashes and the SELECT icon is turned off. "ADJUST TIME or START" is then displayed as shown in FIG. 14. The time may be adjusted or the START pad pressed.

When the power level pad is pressed at an acceptable time during lightwave cooking, i.e., one or more of the lamps are energized, the cooking countdown continues and the UPL (FIG. 11), LPL (FIG. 12) and MPL (FIG. 13) displays appear. The same operation as described above is utilized except that after entering the new microwave power level, 2 short beeps are sounded and the countdown and UPL, LPL and MPL display continue for 2.0 seconds. After 2.0 seconds, the UPL, LPL and MPL displays are removed and only the cooking countdown continues. If the power level pad is pressed when it is not allowed to change/enter or recall the power level, a beep signal (0.5 seconds at 1000 hz) sounds and the message "POWER LEVEL MAY NOT BE CHANGED AT THIS TIME" scrolls on display 114. After the scroll has completed, the previous foreground features return. If the power level pad is pressed at a time when a change/entry is allowed, but no dial rotation or entry occurs within 15 seconds, the UPL, LPL and MPL display are removed and the display returns to the cooking countdown.

Figure 15:
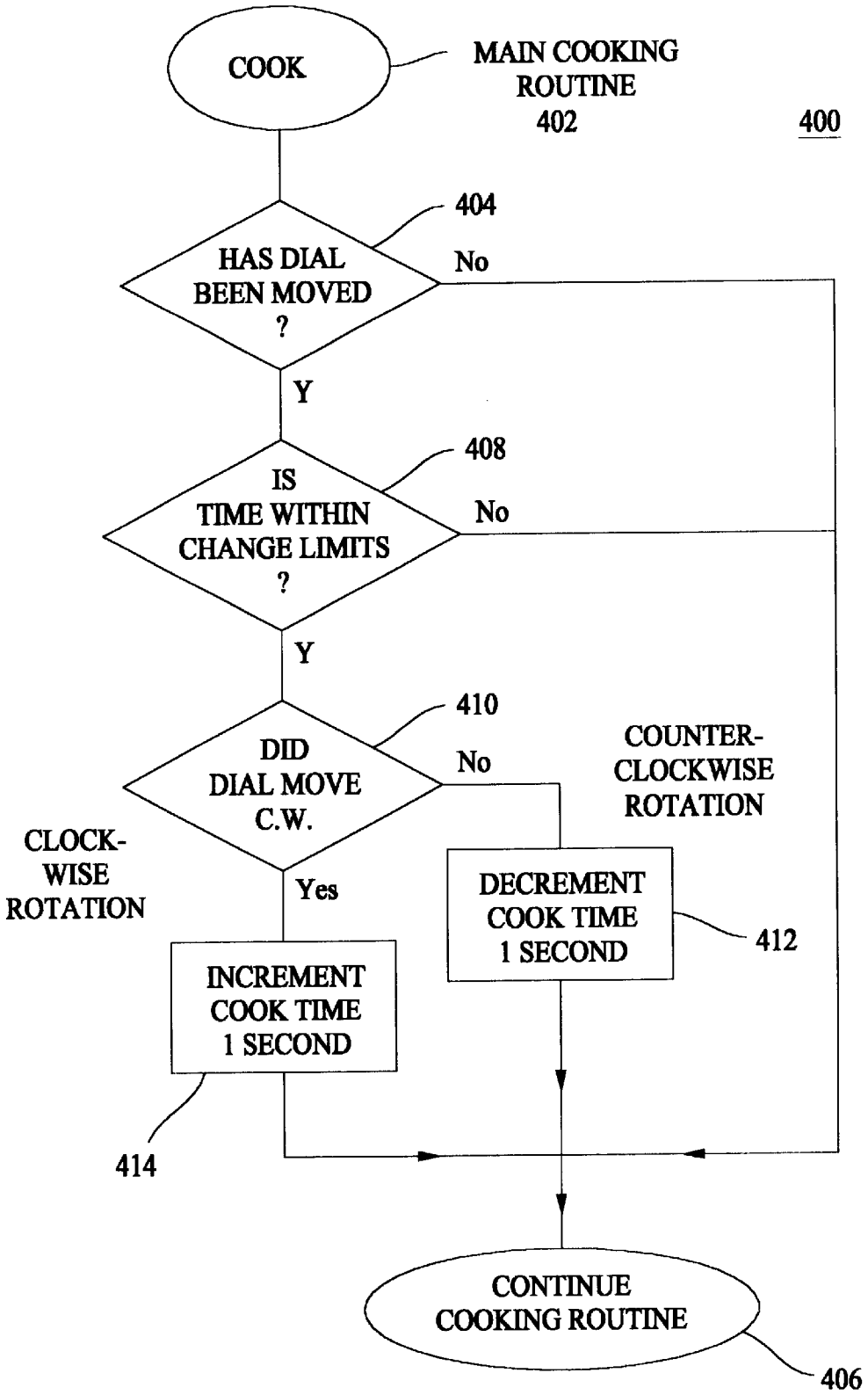
FIG. 15 is a flow chart illustrating process steps executed when adjusting the cook time.

FIG. 15 is a flow chart 400 illustrating process steps executed when adjusting the cook time during cooking operations. During cooking operations, a main cooking routine COOK is executed. If dial 114 is not moved 404, the main cooking routine continues to be executed 406. If dial 114 is moved, then the microcomputer determines whether a time change can be made, e.g., is the time remaining within the change limits 408. If the remaining time is not within the change limits, then the main cooking routine continues to be executed 406. If the remaining time is within the change limits, then the microcomputer determines whether dial 114 was moved clockwise 410. In one exemplary embodiment the change limit is zeroseconds. If no (i.e., dial 114 was moved counterclockwise), then for each increment that dial 114 is moved, the cook time is decremented by one second 412. If yes, then for each increment that dial 114 is moved, the cook time is incremented by one second 414.

Figure 16:
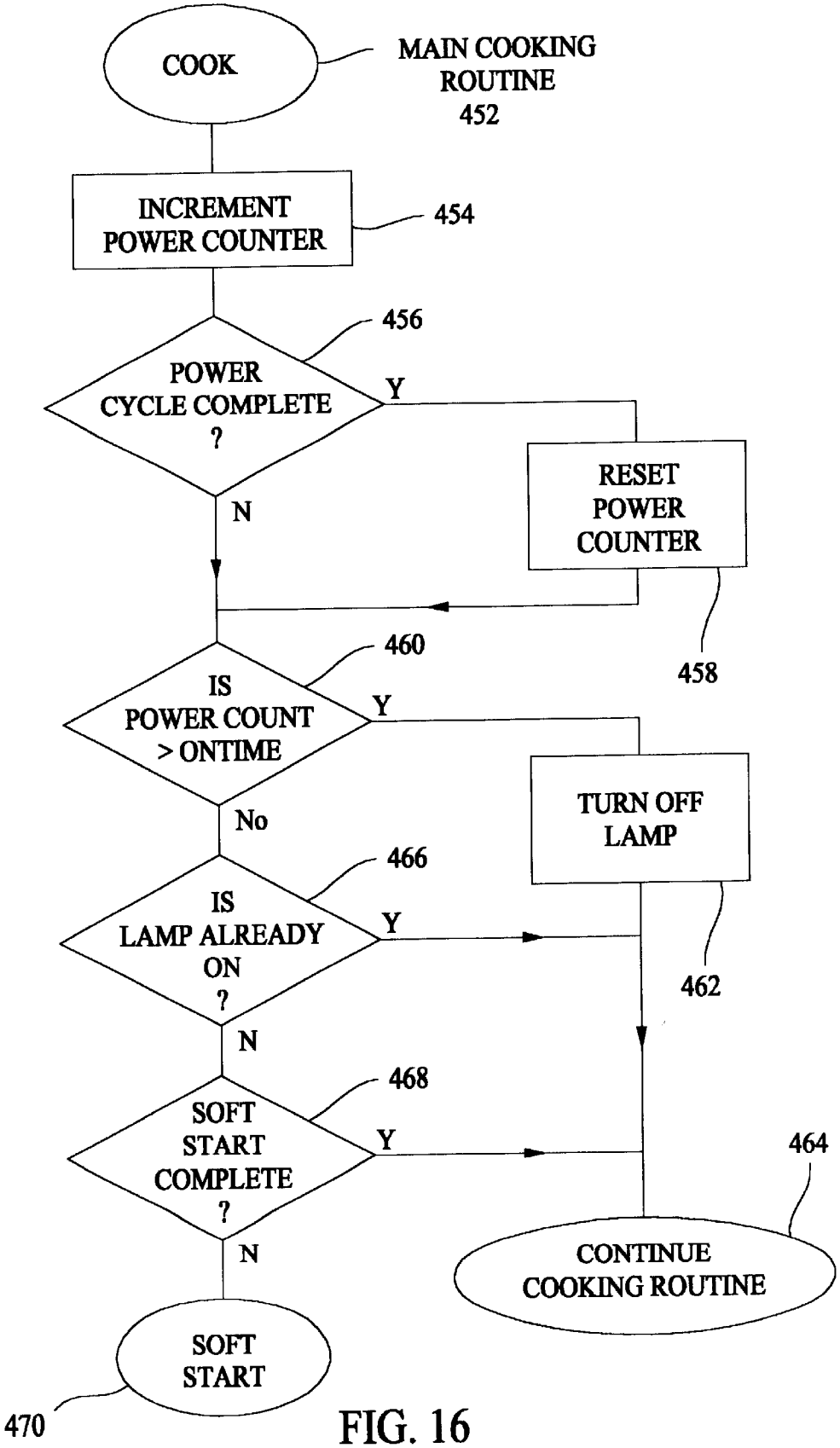
FIG. 16 is a flow chart illustrating process steps for lamp power level control.

FIG. 16 is a flow chart illustrating process steps 450 for lamp power level control. Such control is used to control energization of lamps 124, 126, and 156 (FIG. 9). More particularly, a main cooking routine 452 is executed during normal cooking operations. A power counter is incremented 454 for each one second interval, and the microcomputer then checks whether a power cycle is complete 456. For example, and as explained above, each duty cycle has a duration of 32 seconds. If the duty cycle is complete, then the power counter is reset 458. If the duty cycle is not complete, or after resetting the counter, then the microcomputer checks whether the power count is greater than the "on time" 460. The "on time" is equal to the time corresponding to the selected power level for each lamp, as explained above. If the power count is greater than the "on time", then the particular lamp is de-energized 462 and cooking continues with the main cooking routine 464. If the power count is less than or equal to the "on time", then the microcomputer checks whether the lamp is already on 466. If yes, then cooking operations continue 464. If no, then the microcomputer checks whether the soft start has been completed 468. If the soft start has been completed, then operations continue with the cooking routine 464. If soft start operations are not complete, then the soft start routine is called 470.

Figure 17:
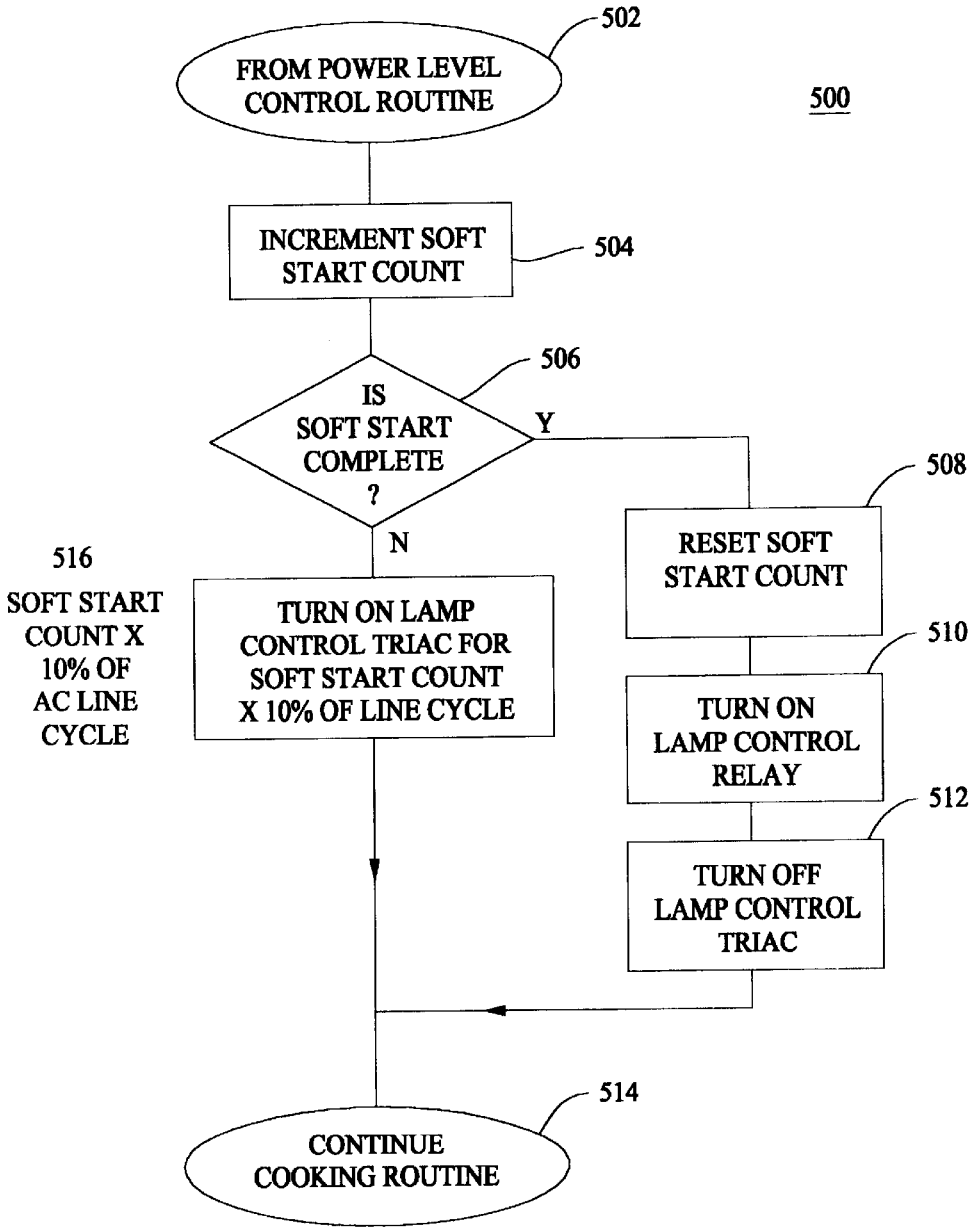
FIG. 17 is a flow chart illustrating process steps for the soft start of the Halogen lamps.

FIG. 17 is a flow chart illustrating process steps for the soft start routine 500. As explained above, the soft start for the halogen lamps is utilized to increase the lamp reliability. When routine 500 is called from the power level control routine 502, the microcomputer then increments a soft start counter 504. The microcomputer then determines whether the soft start is complete (e.g., depending on the lamp, the soft start has a duration of 1 or 2 seconds, as explained above). If soft start is complete, then the microcomputer resets the soft start counter 508, turns on the lamp control relay 510, and turns off the lamp control triac 512. Operations then proceed to the cooking routine 514. If soft start is not complete, then the microcomputer turns on the lamp control triac for a soft start count×10% of the line cycle 516. Operations then proceed to the cooking routine.

The glass of the oven door is very dark and does not enable visualization of food within cavity 122 unless at least one of the Halogen lamps is on and sufficiently energized to illuminate cavity 122. Therefore, in some cooking operations such as the microwave only mode of cooking or when radiant cooking at low power levels, and in order to visualize food in cooking cavity 122, an operator may select the microwave button on keypad 112. When this pad is selected during cooking, the microcomputer energizes upper center lamp 124 for four seconds at full power (i.e., power level 10), with a soft start, i.e., two seconds of soft start and two seconds of power level 10 energization for a total of four seconds, as described above. Lamp 124 illuminates the cooking cavity sufficiently so that an operator can visualize the food through window 106.

Figure 18:
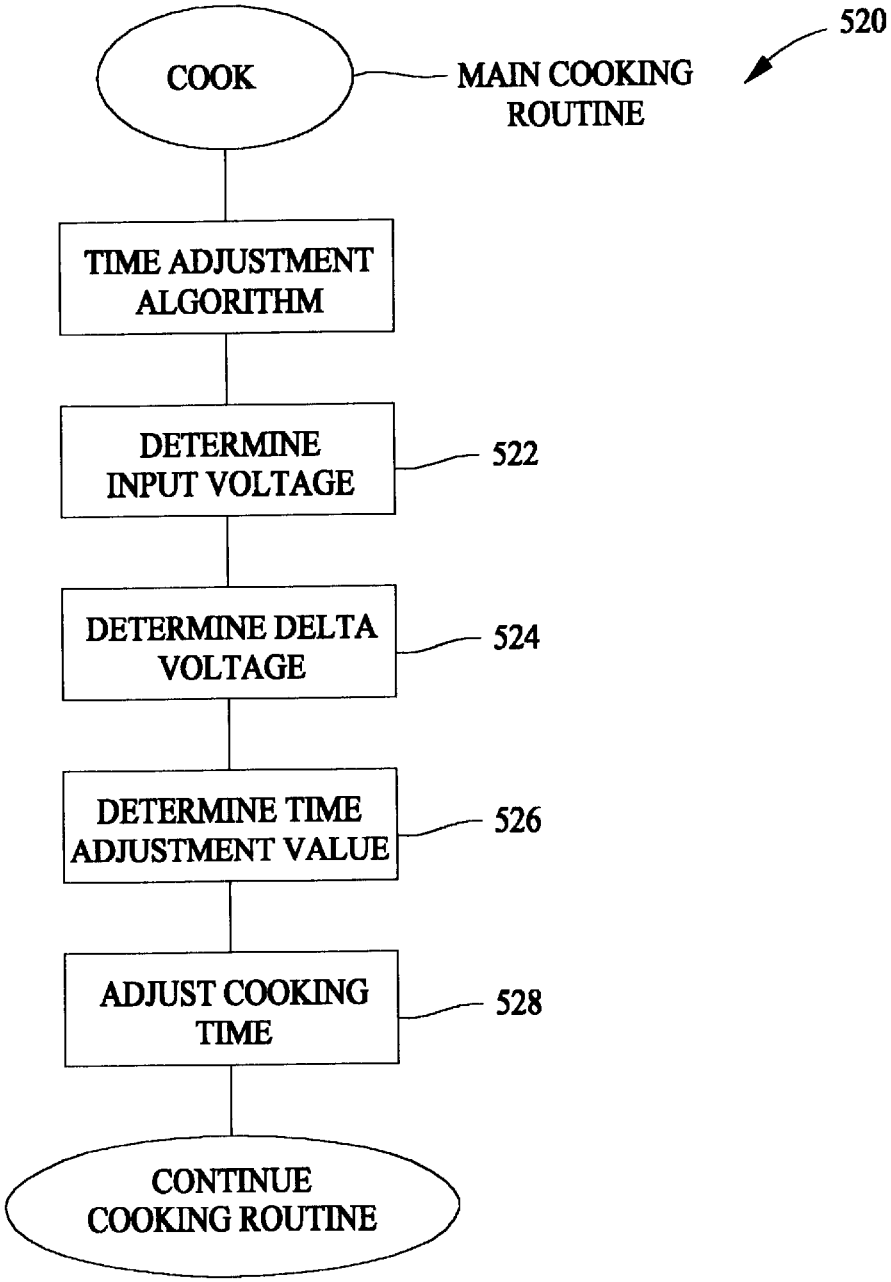
FIG. 18 is a flow chart illustrating process steps of a time adjustment algorithm.

FIG. 18 is a flow chart of a time adjustment algorithm or method 520 to compensate for varying input voltages to lamps 124, 126, and 156. Time adjustment algorithm 520 is utilized to provide that total energy into the food is constant for an input voltage in a range between about 108 Volts and 132 Volts. More particularly, and in one embodiment, time adjustment algorithm provides that total cooking time is adjusted by subtracting or adding a time adjustment value to a selected total cooking time. The time adjustment value, in one embodiment, is determined in accordance with the following relationship.

$$\text{Time Adjustment}=\text{Total cooking time}*\{5(\text{Voltage Deviation}/120\ \text{Volts})^2-1.5(\text{Voltage Deviation}/120\ \text{Volts})\}$$

The total cooking time adjustment value 526 is determined as described above by mathematical manipulation of a voltage ratio calculated by dividing a voltage deviation value by the nominal input voltage 524. The voltage deviation value is the deviation from nominal 120 Volts, i.e., actual voltage level minus 120 Volts. The actual voltage level is determined by the microcomputer sampling the input voltage 522 to lamps 124, 126, and 156. The time adjustment value 526 may have a positive or negative value, and is simply added to the total cooking time value to determine an adjusted cooking time 528. Specifically, the time adjustment is determined by the microcomputer prior to initiating cooking, i.e., by determining the magnitude of the input voltage and determining the time adjustment value as set forth above, and is added to the initial total cook time determined based on the user inputs as described above.

For example, if the cooking algorithm selected requires that the upper lamps be energized for a total of 4:00 minutes (240 seconds) at nominal (120V) conditions, then the following adjustments would be made for off-nominal conditions.

If line voltage is 132V, then:

$$\Delta V=132-120=12V.\ \text{So}\ \Delta V/V_0=12/120=0.1$$

$$\text{Then}\ \Delta T/T_0=5(\Delta V/V_0)^2-1.5(\Delta V/V_0)$$
$$=5*0.01-1.5*0.1=-0.1$$

Therefore, $\Delta T=-0.1*T_0=-0.1*(240\ \text{sec})=-24$ seconds. At an input voltage of 132 volts, the total cook time used for controlling energization of the upper lamps would be reduced in total time from 240 seconds to 216 seconds.

If the line voltage is 116V, then:

$$\Delta V=116-120=-4V.\ \text{So}\ \Delta V/V_0=-4/120=-0.0333$$

$$\text{Then}\ \Delta T/T_0=5(\Delta V/V_0)^2-1.5(\Delta V/V_0)$$
$$=5*0.00111-1.5*-0.0333=+0.0555$$

Therefore, $\Delta T=+0.0555*T_0=+0.0555*(240\ \text{sec})=+13.3$ seconds At an input voltage of 116 volts, the total cook time used for controlling energization of the upper lamps would be increased in total time from 240 seconds to 253 seconds.

In one specific example for cooking a biscuit, the algorithm is:

4:30 $U$=10 $L$=05 $M$=06

As a result, the cooking elements are controlled as summarized below.

| | Time | UE | UC | Lower | MW |
|---|---|---|---|---|---|
| Algorithm | 270 sec | 10 | 10 | 5 | 6 |
| Duty Cycle (sec) | | 32 | 32 | 32 | 32 |
| On time per cycle (sec) | | 32 | 27 | 16 | 19 |
| Total On Time (sec) | | 270 | 230 | 142 | 166 |

Over the 270 second run time, 8.4375 duty cycles are executed, which means 8 complete cycles occur, plus the first 14 seconds of a ninth cycle.

If the line voltage is 108V, then:

$$\Delta T/T0=5(\Delta V/V_0)^2-1.5(\Delta V/V_0)=5*0.01-1.5*-0.1=+0.2$$

If the line voltage is 132V, then:

$$\Delta T/T0=5(\Delta V/V_0)^2-1.5(\Delta V/V_0)=5*0.01-1.5*-0.1=-0.1$$

The time to be added for each component is set forth below.

| | Time | UE | UC | Lower | MW |
|---|---|---|---|---|---|
| Algorithm | 270 sec | 10 | 10 | 5 | 6 |
| Total on Time (sec) | 270 | 270 | 230 | 142 | 166 |
| Delta Time at 132 V (sec) | −27 | −27 | −23 | −14 | −17 |
| Delta Time at 108 V (sec) | +54 | +54 | +46 | +28 | +33 |

In order to adjust all of the component cook times by the proper amount, only the overall cook time needs to be adjusted by the amount indicated by the equation set forth above, and execution of duty cycles is continued. Thus, in the examples above, the total cook time would be adjusted by −27 seconds for 132V and by +54 seconds for 108V. Specifically, for 132V, the total cook time is 270−27=243 seconds, which results in 7 full duty cycles plus one partial cycle 19 seconds long. The algorithm would then execute as summarized below.

| | Time | UE | UC | Lower | MW |
|---|---|---|---|---|---|
| Algorithm | 232 sec | 10 | 10 | 5 | 6 |
| Duty Cycle (sec) | | 32 | 32 | 32 | 32 |
| On time per cycle (sec) | | 32 | 27 | 16 | 19 |
| Total On Time (sec) | | 243 | 208 | 128 | 152 |

Over the 243 second run time, 7.59375 duty cycles are executed, which means 7 complete cycles occur, plus the first 19 seconds of an eighth cycle. The times for the lamps and microwave are identical to the target times calculated above.

For 108V, the total cook time is 270+54=324 seconds, which results in 10 full duty cycles plus one partial cycle 4 seconds long. The algorithm would then execute as summarized below.

| | Time | UE | UC | Lower | MW |
|---|---|---|---|---|---|
| Algorithm | 324 sec | 10 | 10 | 5 | 6 |
| Duty Cycle (sec) | | 32 | 32 | 32 | 32 |
| On time per cycle (sec) | | 32 | 27 | 16 | 19 |
| Total On Time (sec) | | 324 | 274 | 164 | 193 |

Over the 324 second run time, 10.125 duty cycles are executed, which means 10 complete cycles occur, plus the first 4 seconds of a tenth cycle.

If a 120 second cook time is programmed, three 32 second full blocks plus one 24 second partial block, with the on time for each component occurring at the beginning of each block, even the partial one, are executed. Thus, if a component is scheduled to be on for 27 seconds of each 32 second duty cycle, the following control is executed.

| | |
|---|---|
| 27 sec on | |
| 5 sec off | DC 1 (duty cycle 1) |
| 27 sec on | |
| 5 sec off | DC 2 (duty cycle 2) |

-continued

| | | |
|---|---|---|
| | 27 sec on | |
| | 5 sec off | DC 3 (duty cycle 3) |
| | 24 sec on | 24 sec partial DC 4 (partial duty cycle 4) |
| total | 120 seconds. | |

Similarly, if another component is scheduled to be on for 18 seconds of each duty cycle, the following control is executed.

| | | |
|---|---|---|
| | 18 sec on | |
| | 14 sec off | DC 1 (duty cycle 1) |
| | 18 sec on | |
| | 14 sec off | DC 2 (duty cycle 2) |
| | 18 sec on | |
| | 14 sec off | DC 3 (duty cycle 3) |
| | 18 sec off | |
| | 6 sec off | 24 sec partial DC 4 (partial duty cycle 4) |
| total | 120 seconds | |

Using the above described time adjustment, the total energy into the food is maintained constant for input voltages in a range between about 108 Volts and 132 Volts. Such time adjustment provides that suitable cooking results are achieved even when the input voltage varies over a wide range.

It is contemplated that the time adjustment algorithm could be implemented in various forms within the scope of the invention. For example, in one embodiment, the microprocessor is programmed to calculate a time adjustment value using the quadratic equation set forth above, namely, $$\Delta T/T_0=5(\Delta V/V_0)^2-1.5(\Delta V/V_0) \text{ or } \Delta T=T_0[5(\Delta V/V_0)^2-1.5(\Delta V/V_0)].$$

In an alternative embodiment, the quadratic equation set forth above may be approximated by two linear equations over a selected operating range of an oven voltage input, for example, 108V to 132V. More specifically, for input voltage from 108V to 120V, the time adjustment value may be approximated by the linear relationship $$\Delta T/T_0=-2(\Delta V/V_0)$$

and for input voltages from 120V to 132V, the time adjustment value may be approximated by the linear relationship $$\Delta T/T_0=-1(\Delta V/V_0).$$

These linear relationships closely approximate the above quadratic relationship over the oven operating range of interest. In a further alternative embodiment, the microcomputer calculates time adjustment values using these approximate linear relationships.

In yet another embodiment, microcomputer includes a memory with predetermined time adjustment values corresponding to a range of input voltages. Therefore, rather than calculating a time adjustment value, microcomputer selects an appropriate pre-calculated time adjustment value from a look-table stored in the memory of the microcomputer corresponding to the sampled input voltage. Once selecting the appropriate time adjustment value, the microcomputer adds the time adjustment value to the selected cooking time and executes an appropriate number of duty cycles.

While the invention has been described in terms of various specific embodiments, those skilled in the art will recognize that the invention can be practiced with modification within the spirit and scope of the claims.

APPENDIX A

-A1-

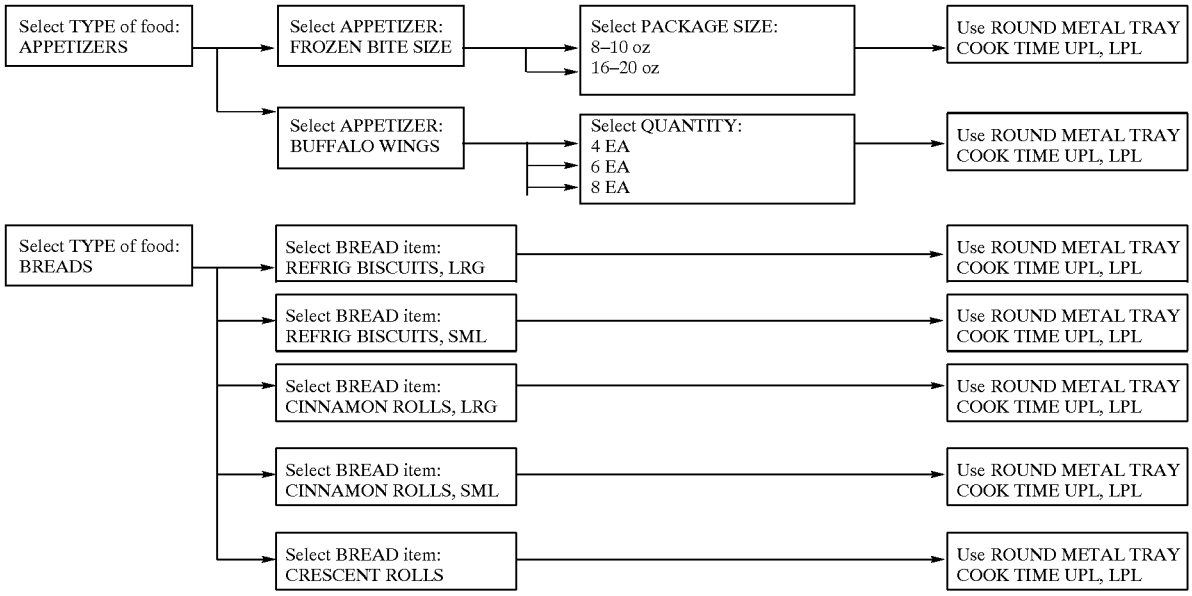

-continued
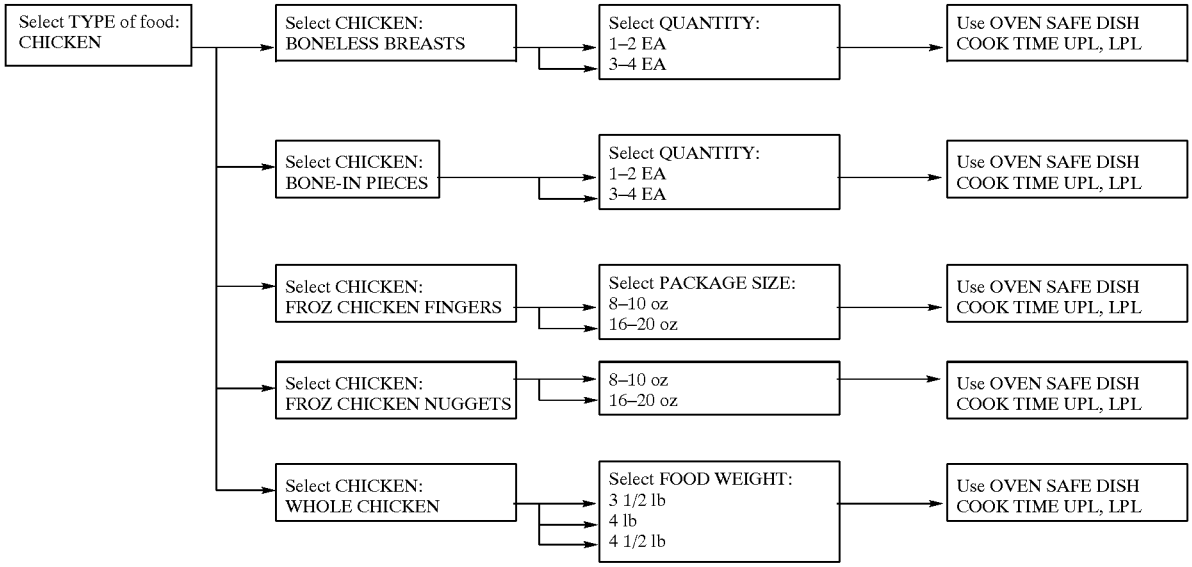
APPENDIX A
-A2-
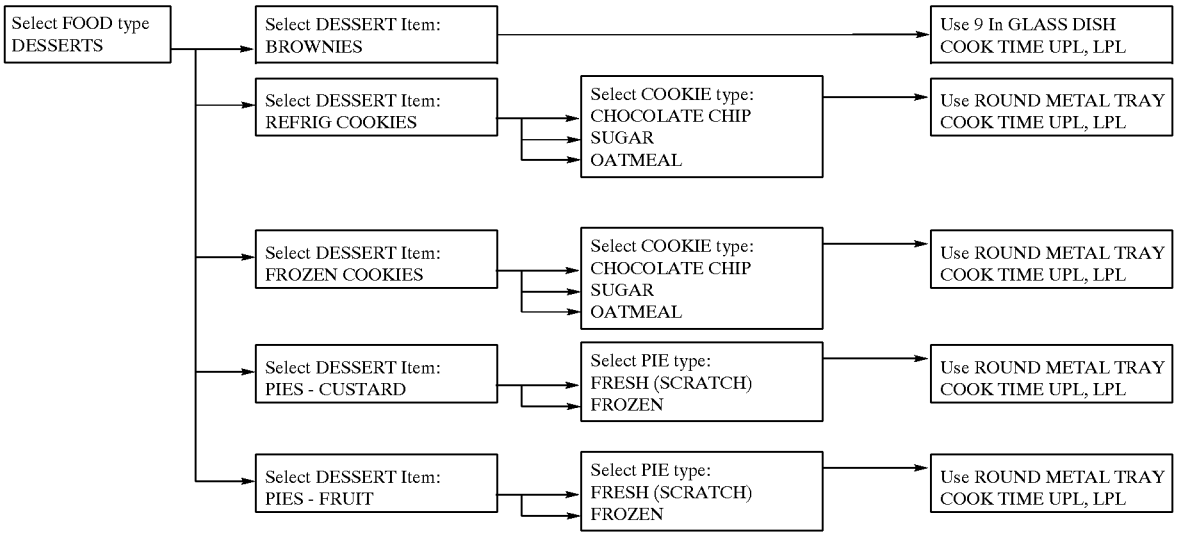
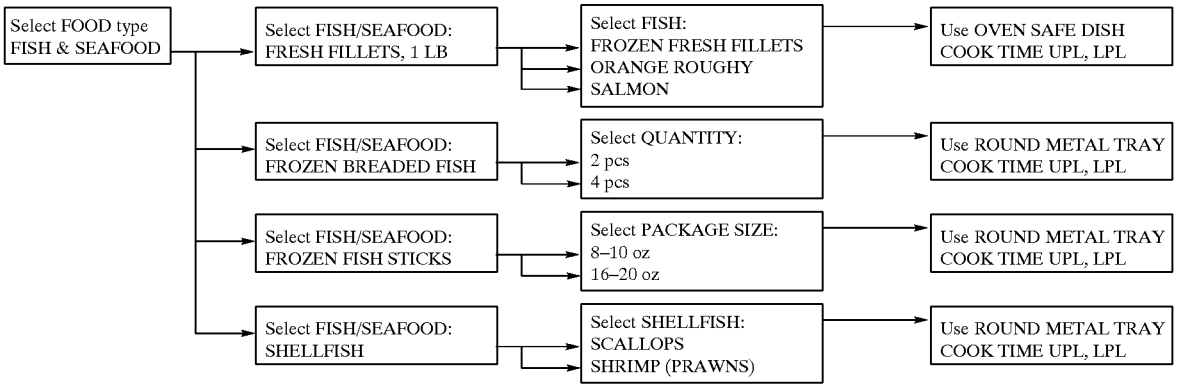

-continued
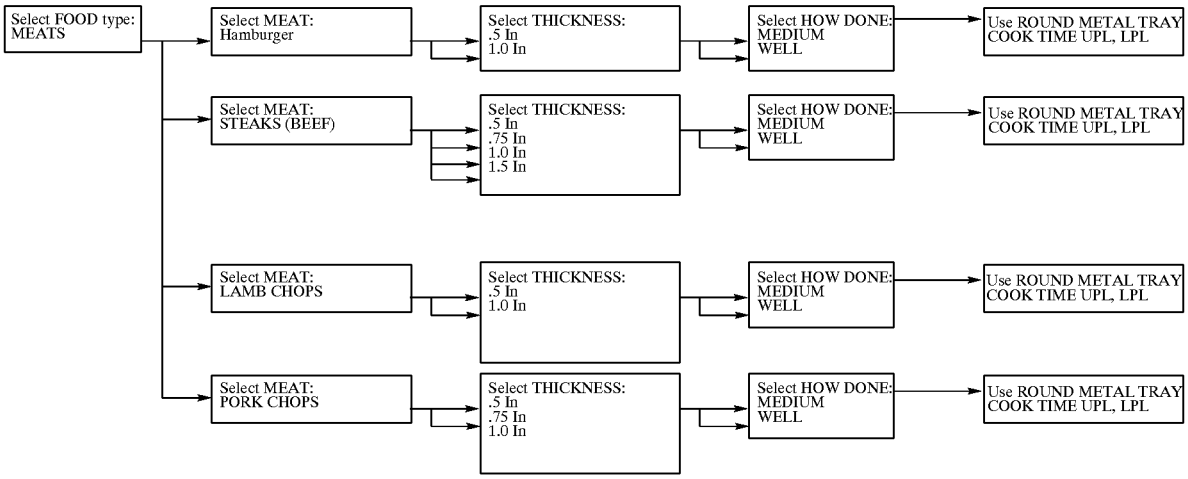
APPENDIX A
-A3-
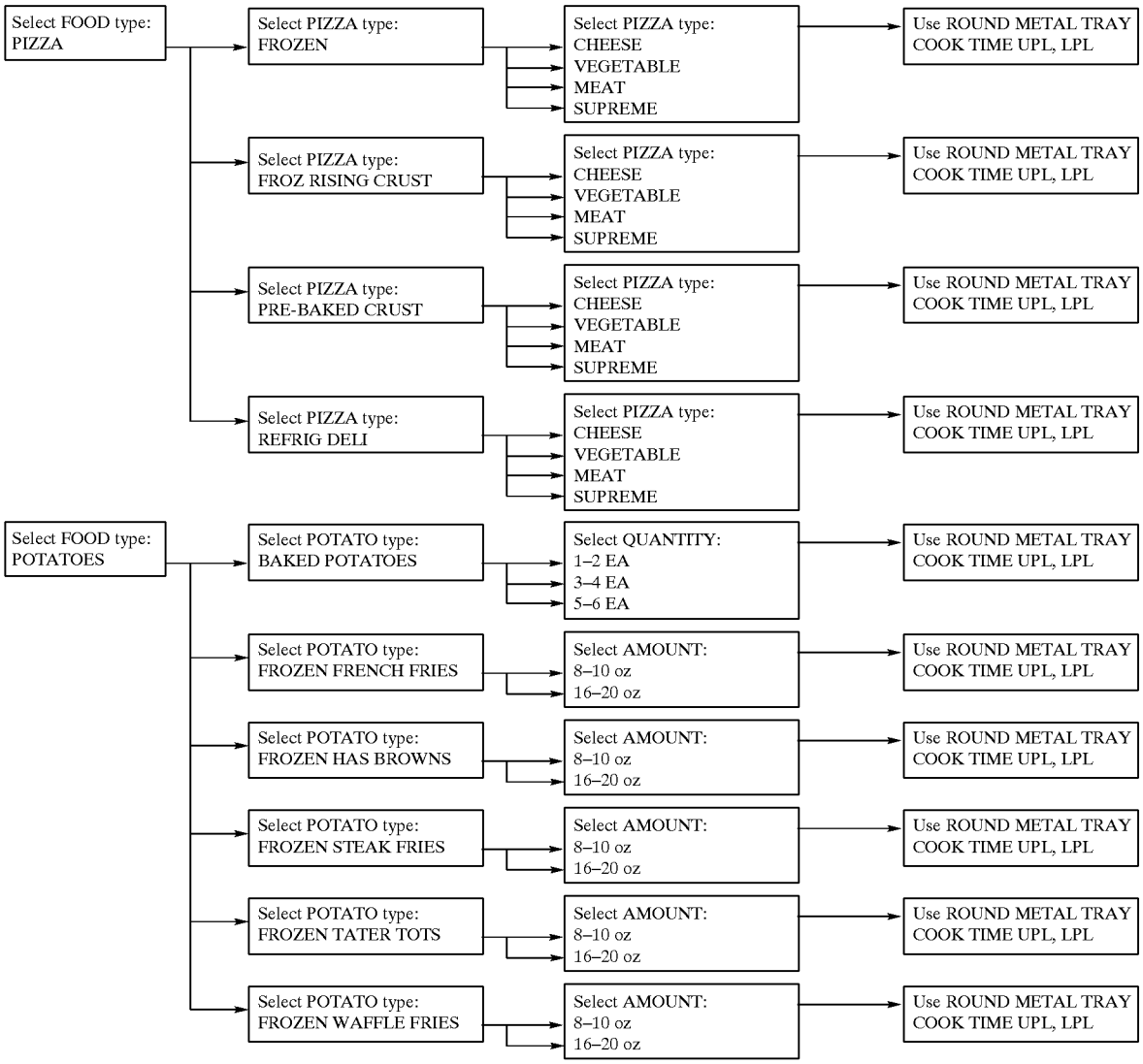

-continued

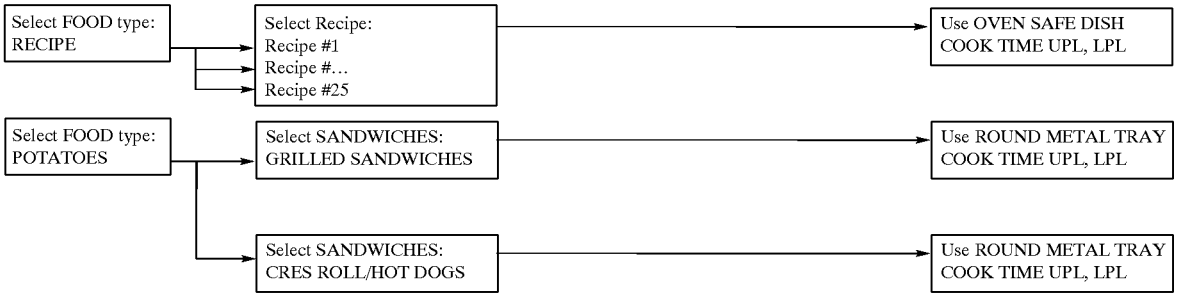

What is claimed is:

1. A method for maintaining a constant energy into food being cooked in an oven including a microwave cooking unit, at least one radiant cooking unit, a control panel and a microcomputer for executing desired cooking operations of the microwave cooking unit and radiant cooking unit in accordance with selected user inputs to the control panel, the user inputs including a cooking time and cooking power levels for the respective cooking units, the oven connected to a power source including an input voltage to the oven, said method comprising the steps of:

determining a magnitude of the input voltage to the oven;

comparing the determined input voltage to a nominal input voltage;

calculating a delta voltage ratio;

determining a time adjustment value comprising the steps of:

squaring the delta voltage ratio to determine a squared voltage ratio;

multiplying the squared voltage ratio by 5; and subtracting 1.5 times the delta voltage ratio;

adding the time adjustment value to the user selected cooking time to determine an adjusted cooking time; and operating the microwave cooking unit and radiant cooking unit for the adjusted cooking time.

2. A method in accordance with claim 1 wherein the step of determined a delta voltage ratio comprises the steps of:

subtracting the nominal voltage from the determined input voltage to determine a voltage difference; and dividing the voltage difference by the nominal voltage.

3. A method in accordance with claim 2 wherein the nominal voltage is 120V.

4. A method in accordance with claim 1 wherein said step of determining a time adjustment value comprises the step of approximating a time adjustment value by multiplying the input cooking time by the product of a voltage constant and the delta voltage ratio where the voltage constant is −2 when the input voltage is less than about 120 volts and the voltage constant is −1 when tie input voltage is greater than about 120 volts.

5. A method in accordance with claim 1 wherein the step of operating the microwave cooking unit and radiant cooking unit comprises the step of:

selecting a respective duty cycle target on time for the microwave cooking unit and radiant cooking unit according to user selected power level inputs; and energizing the respective cooking units for the respective target on times during a duty cycle;

de-energizing the respective cooking units for a respective remainder of the duty cycle, and repeating the duty cycles until the adjusted cooking time has elapsed.

6. A method in accordance with claim 5 wherein the duty cycle is approximately 32 seconds.

7. A method in accordance with claim 5 further comprising the step of adjusting the target on time of the radiant cooking unit to accommodate soft start operation.

8. A method in accordance with claim 5 wherein the step of repeating duty cycles until the adjusted time has elapsed comprises the steps of executing a partial duty cycle when the completion of a complete duty cycle would exceed the adjusted time.

9. A method in accordance with claim 1 wherein the input voltage fluctuates from about 108V to about 132V.

10. A method in accordance with claim 1 wherein the microcomputer includes a memory loaded with predetermined time adjustment values corresponding to a range of input voltages, said step of adjusting the cooking time comprising the step of selecting a time adjustment value from the memory corresponding to the determined input voltage.

11. A combination microwave/radiant oven for connection to a power source including an input voltage, said oven comprising:

a cooking cavity;

a microcomputer programmed to determine a magnitude of the input voltage and to determine a time adjustment value according to a relationship $\Delta T/T0=X(\Delta V/V0)$ where X=−2 when the input voltage is less than about 120V, and X=−1 when the input voltage is greater than 120V;

a microwave cooking unit for deliver microwave energy to said cooking cavity and operatively connected to the microcomputer;

at least one radiant cooking unit for delivering radiant energy to said cooking cavity and operatively connected to the microcomputer; and said microcomputer operating said microwave cooking unit and said at least one radiant cooking unit in accordance with a selected cooking time and selected cooking power levels for the respective cooking units, and said microcomputer programmed to adjust the selected cooking time based on said time adjustment value to ensure delivery of a constant energy into said cooking cavity despite fluctuation in the input voltage.

12. A combination oven m accordance with claim 13 wherein said microcomputer is further programmed to determine a time adjustment value according to a relationship $$\text{Time Adjustment}=\text{Total cooking time}*\{5(\text{Voltage Deviation}/120\ \text{Volts})^2-1.5(\text{Voltage Deviation}/120\ \text{Volts})\}$$

where Total cooking time is the selected cooking time, Voltage deviation equals said magnitude of input voltage minus a nominal input voltage.

13. A combination oven in accordance with claim 11 wherein said microcomputer comprises a memory, said microcomputer programmed to select a predetermined time adjustment value from a look-up table of time adjustment values stored in said memory.

14. A combination oven in accordance with claim 11 wherein said nominal voltage is 120V.

15. A combination oven in accordance with claim 11 wherein said microcomputer is programmed to deliver a constant stream of energy into said cooking cavity when the input voltage fluctuates from about 108V to about 132V.

16. A combination microwave/radiant oven for connection to a power source including an input voltage that fluctuates from about 108V to about 132V, said oven comprising:

a cooking cavity;

a microcomputer;

a microwave cooking unit for delivering microwave energy to said cooking cavity and operatively connected to the microcomputer;

at least one radiant cooking unit for delivering radiant energy to said cooking cavity and operatively connected to the microcomputer;

a control panel operatively coupled to said microcomputer for accepting a user selected cooking time input and selected cooking power levels for the respective cooking units;

said microcomputer operating said microwave cooking unit and said at least one radiant cooking unit in accordance with said user selected cooking time and power levels; and said microcomputer programmed to determine the input voltage and adjust selected cooking time by a time adjustment value determined by the relationship $$\text{Time Adjustment}=\text{Total cooking time}*\{5(\text{Voltage Deviation}/120\ \text{Volts})^2-1.5(\text{Voltage Deviation}/120\ \text{Volts})\}$$

where Total cooking time is the selected cooking time, Voltage deviation equals the determined input voltage minus a nominal input voltage.

* * * * *

UNITED STATES PATENT AND TRADEMARK OFFICE

CERTIFICATE OF CORRECTION

PATENT NO. : 6,696,676 B2 
DATED : February 24, 2004
INVENTOR(S) : Graves et al.

It is certified that error appears in the above-identified patent and that said Letters Patent is hereby corrected as shown below:

Column 18,
Line 59, after "A combination oven" delete "m" and insert therefor -- in --.
Line 59, after "accordance with claim" delete "13" and insert therefor -- 11 --.

Signed and Sealed this

Twenty-second Day of November, 2005

JON W. DUDAS
*Director of the United States Patent and Trademark Office*